US005221134A

United States Patent [19]

Grass

[11] Patent Number: 5,221,134

[45] Date of Patent: Jun. 22, 1993

[54] DRAWER

[75] Inventor: Alfred Grass, Hochst/Vlbg., Austria

[73] Assignee: Grass AG, Hochst/Vlbg., Austria

[21] Appl. No.: 599,623

[22] Filed: Oct. 18, 1990

[30] Foreign Application Priority Data

Dec. 23, 1989 [DE] Fed. Rep. of Germany ..... 3942897

[51] Int. Cl.[5] ..... A47B 95/00

[52] U.S. Cl. ..... 312/348.2

[58] Field of Search ..... 312/348.4, 348.1, 330.1, 312/263, 265.5, 258

[56] References Cited

U.S. PATENT DOCUMENTS 1,822,448 9/1931 Morin ..... 312/348.1
2,522,097 9/1950 Cookson ..... 312/263
4,850,659 7/1989 Röck et al. ..... 312/330.1

FOREIGN PATENT DOCUMENTS 0685274 of 1930 France ..... 312/348.1
2206034 12/1988 United Kingdom ..... 312/348.1

*Primary Examiner*—Kenneth J. Dorner
*Assistant Examiner*—Gerald A. Anderson

[57] ABSTRACT

A drawer is described which comprises side walls, a back wall, a front panel and a drawer bottom. In order, for transport purposes, to reduce the amount of room which the drawer takes up, it is provided that the drawer side walls and the back wall are coupled in a hinge-like manner to the drawer bottom and that the front panel is detachably connected to said parts. There is provided on the drawer bottom a downward-directed projection which engages in an open groove of a side wall or of the back wall and fills the groove force-lockingly in the manner of an initial tension, the groove having an inward-directed hook-like projection and an opening through which the projection of the drawer bottom engages. Front panel connectors are additionally provided on the side walls for connection to the front panel.

2 Claims, 6 Drawing Sheets

DRAWER

FIELD OF THE INVENTION

The present invention relates to a drawer comprising side walls, a back wall and a front panel as well as a drawer bottom.

BACKGROUND OF THE INVENTION

Previously known drawers always present transport problems. This is because they are already assembled and so take up a relatively large amount of room.

SUMMARY OF THE INVENTION

The basic aim of the present invention is therefore to develop a drawer of the type mentioned initially in such a way that the amount of space it takes up may be reduced for transport purposes.

To achieve said aim, the invention is characterised in that the drawer side walls and the back wall are coupled in a hinged manner to the drawer bottom and that the front panel is detachably connected to said parts.

The given technical disclosure achieves the important advantage that, for transport purposes and for other purposes which require the drawer to take up little space, the volume of the drawer may be reduced by removing the front panel and folding down the side walls and the back wall in a hinge-like manner so that the side walls and the rear wall are substantially flush with the drawer bottom. This allows the drawer to be packed in as compact a manner as possible.

It is therefore possible to stack drawers like this in the minimum space, especially since the folded-down parts are also stackable.

Although it is known to make drawers like this so that they can be disassembled, it is not known to connect said parts in a hinge-like manner to one another to ensure that said parts stay together. With the technical disclosure according to the invention, there is namely the advantage that there is no need to collect together the individual parts and put them together in the correct position at the site of assembly because said parts are already joined together in the correct position and only need to be swivelled upward to complete assembly of the drawers.

BRIEF DESCRIPTION OF THE DRAWINGS

Various embodiments of the invention are illustrated in the drawings.

DETAILED DESCRIPTION OF THE INVENTION

Figure 1:
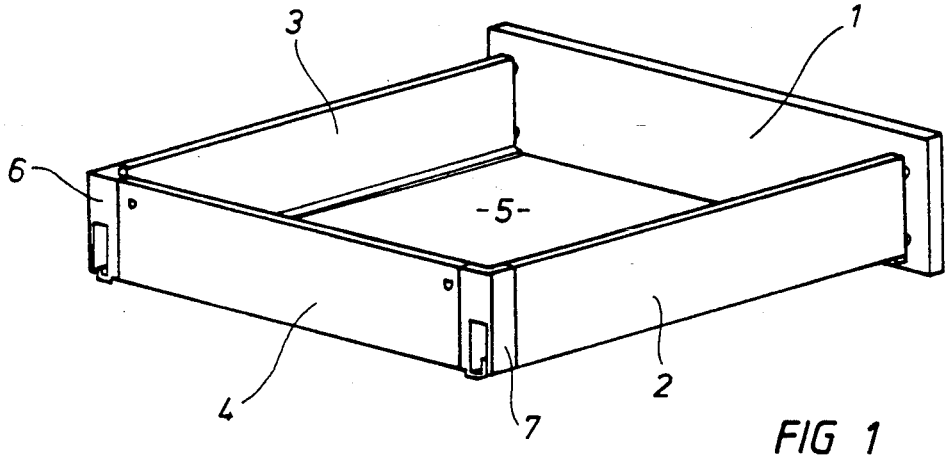
FIG. 1 shows a drawer according to the invention in its assembled state.
Figure 2:
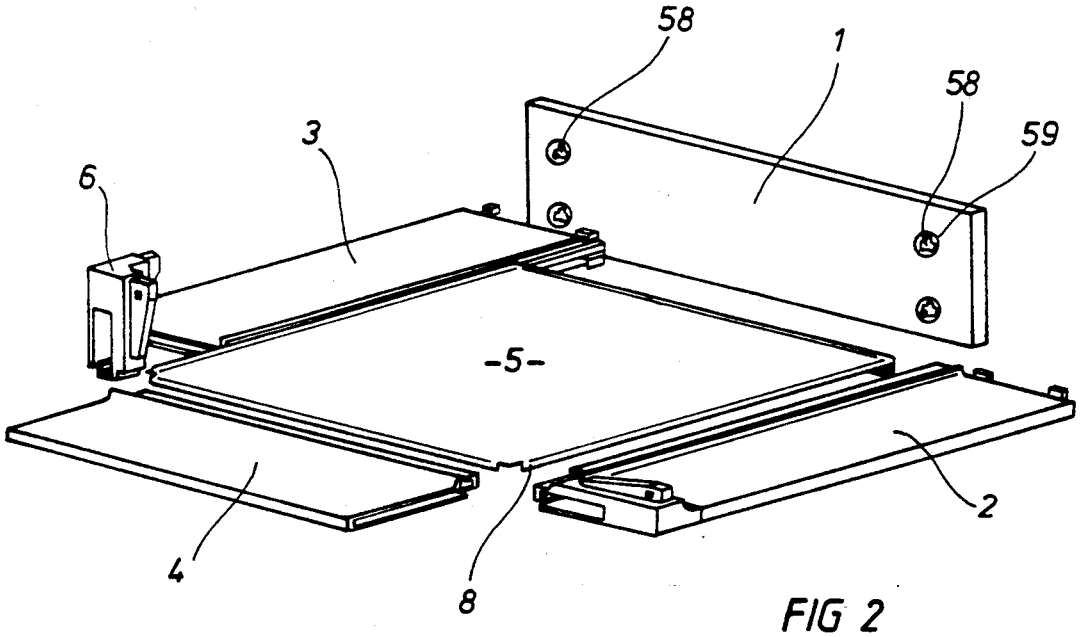
FIG. 2 a drawer according to FIG. 1 only, for the sake of clarity, the parts which are hinged together are shown in an exploded view and are detached from one another, FIG. 3 the hinge-type engagement of the parts of FIG. 2 in their hinged-open state, FIG. 4 the parts of FIG. 3 in their finished assembly state, FIG. 4*a* a hinge-type engagement of a different form, FIG. 5 a perspective view of a corner connector for joining back wall and side wall, FIG. 5*a* a detail of a catch element, FIG. 6 a perspective front view of the side wall with fastening elements for fastening the front panel, FIG. 7 a longitudinal section through the side wall of FIG. 6, FIG. 8 a section through a fastening device at the end close to the front panel for detachable connection to the front panel, FIG. 9 a vertical adjustment device for the front panel, FIG. 10 a diagrammatical view showing the same connection principle as in FIGS. 3 and 4 used for extruded plastic profiles.

The drawer of FIGS. 1 and 2 comprises a front panel 1, side walls 2, 3, a back wall 4 and a drawer bottom 5.

Hinge-type connections are provided in the region between the side walls 2, 3 and the drawer bottom 5 and similarly in the region between the back wall 4 and the drawer bottom 5. Moreover, in the assembled state, corner connectors 6, 7 are additionally provided which join the side walls 2, 3 securely to the back wall 4 in the assembled state.

Figure 3:
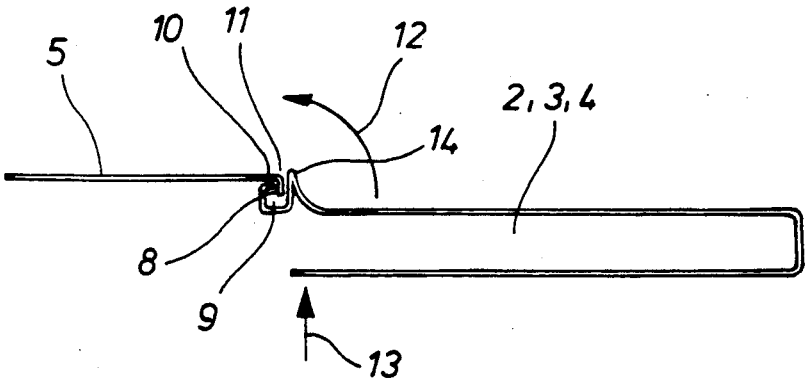
Figure 4:
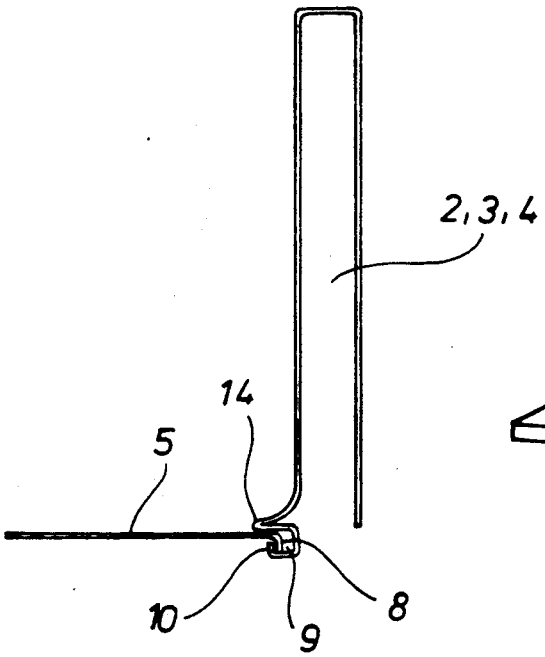

The connection principle of the hinge-like coupled parts 2, 3, 4, 5 is illustrated in FIGS. 3 and 4. Here it may be seen that there is provided on the drawer bottom 5 a downward-directed projection 8 which engages in an open groove 9 of, for example, a side wall 2, 3 or the back wall 4. The groove has an inward-directed projection 10 and an opening 11 through which the projection 8 of the drawer bottom 5 engages. The groove is approximately square or rectangular in cross-section.

If a pressure deployment 13 is effected from below onto the frame parts 2, 3, 4, the drawer bottom 5 is pressed with its projection 8 firmly into the groove 9, and if at the same time a swivel movement is executed in direction 12, the frame part 2, 3, 4 is swivelled and the projection 8 rotates through 90° in the groove 9.

Here it is important that the drawer bottom 5 extends with its surface into the groove 9 and sits there straight-lockingly and form-lockingly in a projection 14 of increased length. The effect hereby achieved is a bracing of the frame parts 2, 3, 4 in the region of the projection 14, with the length of the projection 8 of the drawer bottom being selected so that the width of the groove 9 is then filled thereby in a tensioning and force-locking manner. The resultant effect is therefore a force-locking bracing in the region of said groove.

Figure 4A:
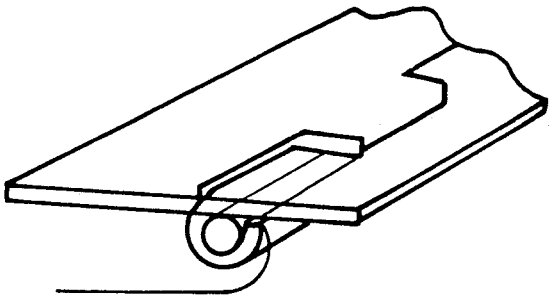

FIG. 4*a* shows a different connection principle, with two semi-circular groove portions being illustrated which engage in one another and may be twisted through 90° relative to one another.

What is illustrated here is a connection principle, similar to that for a piano hinge, which likewise joins two parts together in a hinge-type manner.

The connection solution of FIGS. 3 and 4 may be designed so as to be detachable or non-detachable; i.e. said parts 2, 3, 4 may be joined detachably and pivotably to the drawer bottom 5; it is also provided in another embodiment that the two parts are supported non-detachably but pivotably relative to one another.

Figure 5:
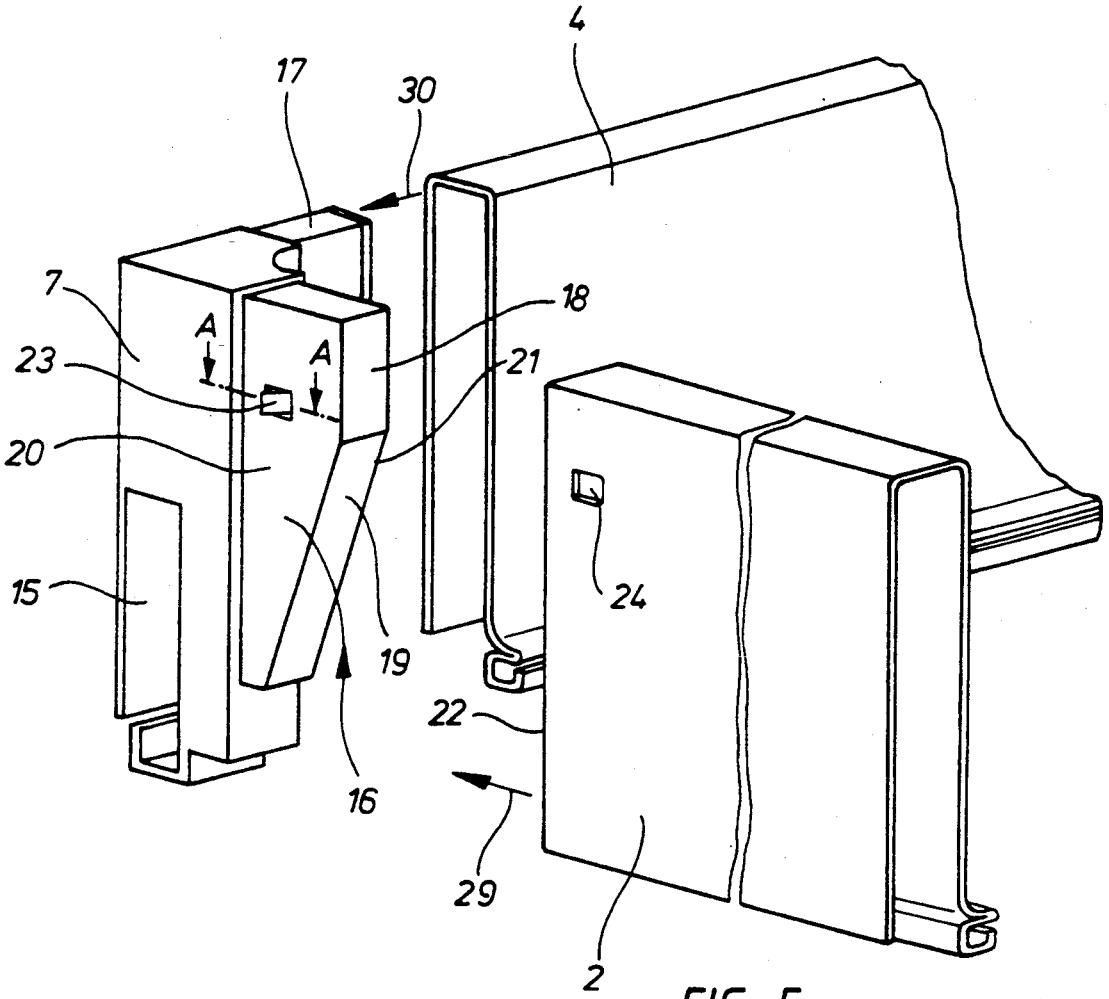

FIG. 5 shows how, for example, a back wall 4 and a side wall 2 are detachably connected to one another by means of a corner connector 7.

The corner connector has a back recess 15 in which a drawer guide rail engages which is not shown in detail and is connected by guide means (not shown) to the body.

The corner connector basically comprises a plastic part on which are moulded lateral projections 16, 17, each of which is offset by 90° relative to the other. Each projection is of identical construction. For reasons of simplification, therefore, only one projection 16 is described.

The projection 16 basically comprises a front face 18 and an angled face 19 originating therefrom.

Side surfaces 20, 21 are additionally provided.

The angled arrangement between the two faces 18, 19 is preferred because it makes centering easier upon insertion into the location hole 22 in the region of the side wall 2.

Detents 23 are provided in the region of the opposing side walls 20, 21, with there being two different options available for this.

In a first embodiment, a detent 23 is provided on one side surface 20 only, with no detents whatsoever being provided on the other side surface 21; in another embodiment, opposing detents may be provided on both side surfaces 20,21.

In the present embodiment, the basis is merely one detent 23 on one side surface 20.

Opposite said detent is a corresponding recess 24 in the region of the outer wall of the part 2.

Figure 5A:
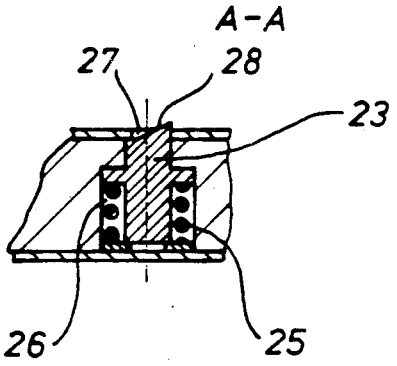

According to FIG. 5*a*, which shows a section along line A—A of FIG. 5, the detent 23 is spring-loaded by means of a helical compression spring 25 and is displaceably supported displaceably in a recess 26 in the furniture connector 7.

The detent in the process engages through a recess 27 in the side wall 20 of the furniture connector and in its locked-in state engages in the recess 24.

The face 28 of the detent 23 is chamfered to allow it, on snapping up, first to slide along the inner wall of the frame part and only then to snap under spring loading into the recess 24.

Otherwise, the connection is effected in arrow direction 29 with the side part and in arrow direction 30 with the back wall.

Instead of the one detent 23 in the side surface 20 of the furniture connector described here, it is also possible to use a plurality of detents spaced apart from one another.

Instead of the detent 23 acted upon by a helical compression spring 25 described here, it is also possible to use ball catches or spring catches with a spiral spring.

All known spring-loaded catch mechanisms therefore come under the protection of the present invention.

Figure 6:
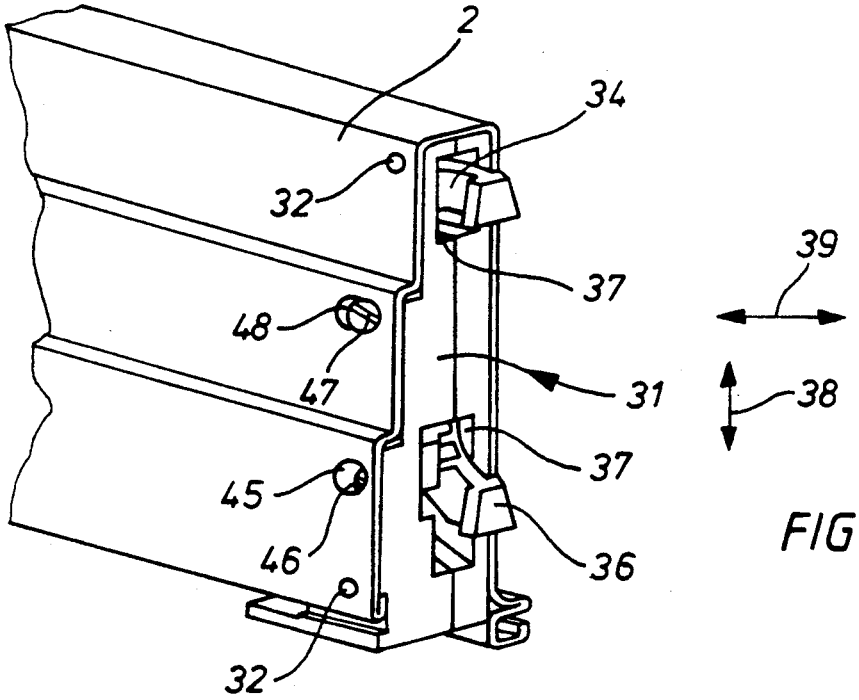
Figure 7:
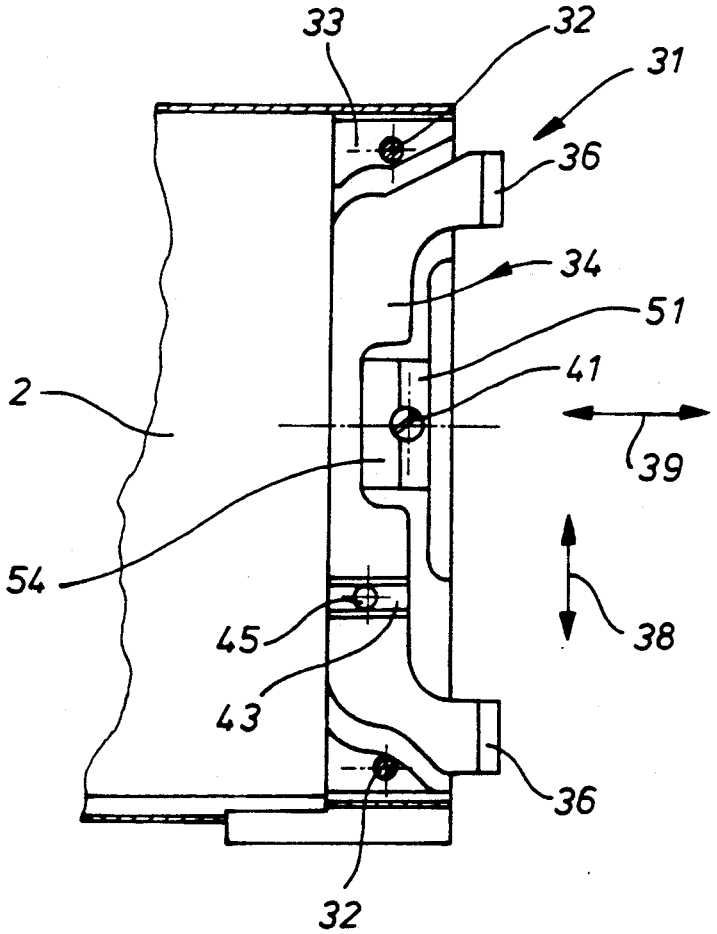

FIGS. 6 and 7 show the detachable connection of the side parts 2,3 to the front panel 1.

A front panel connector 31 is provided which is disposed in a fixed manner in the interior of the side part 2,3.

The connection is effected by means of rivets 32 with the relevant side part 2,3.

The front panel connector basically comprises an aluminum or plastic element 33 which is fastened by the described rivets 32 in the interior of the side part 2,3. Adjustably supported in the plastic element is an adjustable part 34 which in plan view (FIG. 7) has an approximately U-shaped profile and has basically two front projections 36 which effect the detachable connection with the front panel.

Said adjustable part engages with its projections 36 through recesses 37 in the adjustable element 33.

As mentioned initially, the adjustable part 34 is held in the adjustable element 33 so as to be adjustable in two adjustment directions 38,39 which are perpendicular to one another.

Adjustment in arrow direction 39 is effected for the purpose of clamping the front panel in a plane at right angles to the face of the front panel in order to connect the front panel in a force-locking manner to the side parts 2,3 and the drawer bottom 5.

A vertical adjustment is effected in arrow direction 38 in order to set the joint width between several superimposed front panels of a drawer arrangement.

A slope-adjusting arrangement could also additionally be provided.

Figure 9:
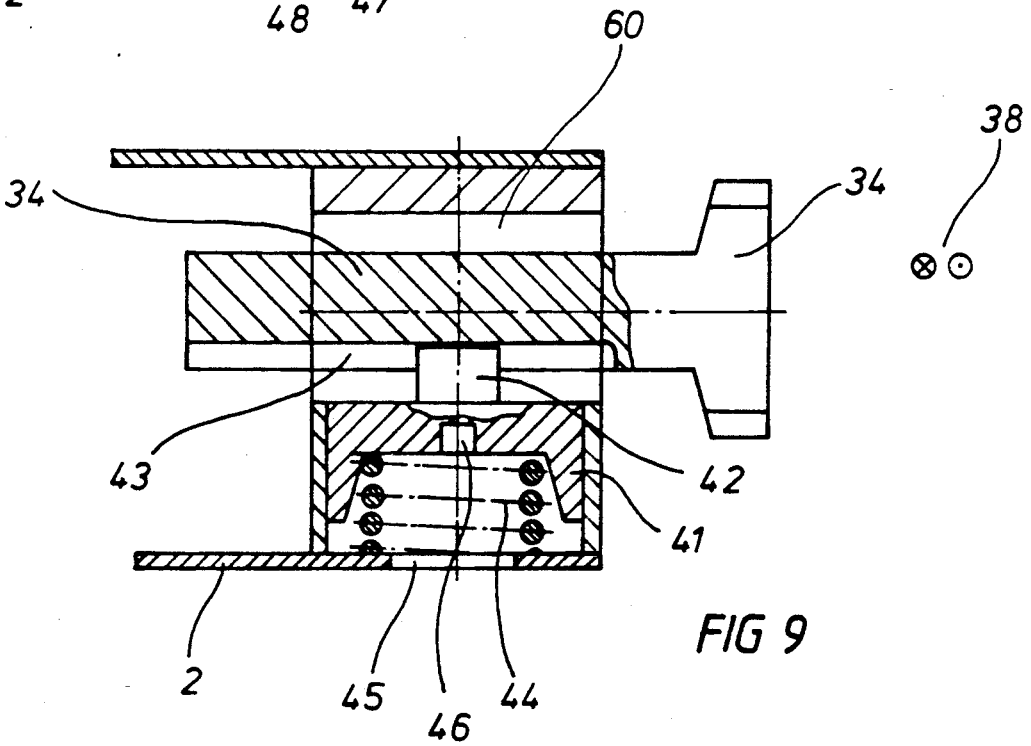

Adjustment in arrow direction 38 is effected as follows:

An adjusting screw 41 is provided which is connected in a torsion-resistant manner at its front face to an eccentric pin 42 (cf. FIG. 9), said eccentric pin 42 engaging in a groove 43 of the adjustable part 34.

The adjusting screw 41 is pressed by means of a spring 44 with its eccentric pin 42 into the groove. A slot 46 of the adjusting screw is accessible through an opening 45 and the adjusting screw may therefore be turned with a tool. In accordance with the turning of said adjusting screw 41, the eccentric pin 42 rotates in the groove 43 and the adjustable part 34 is adjusted at right angles to the drawing plane of FIG. 9

Figure 8:
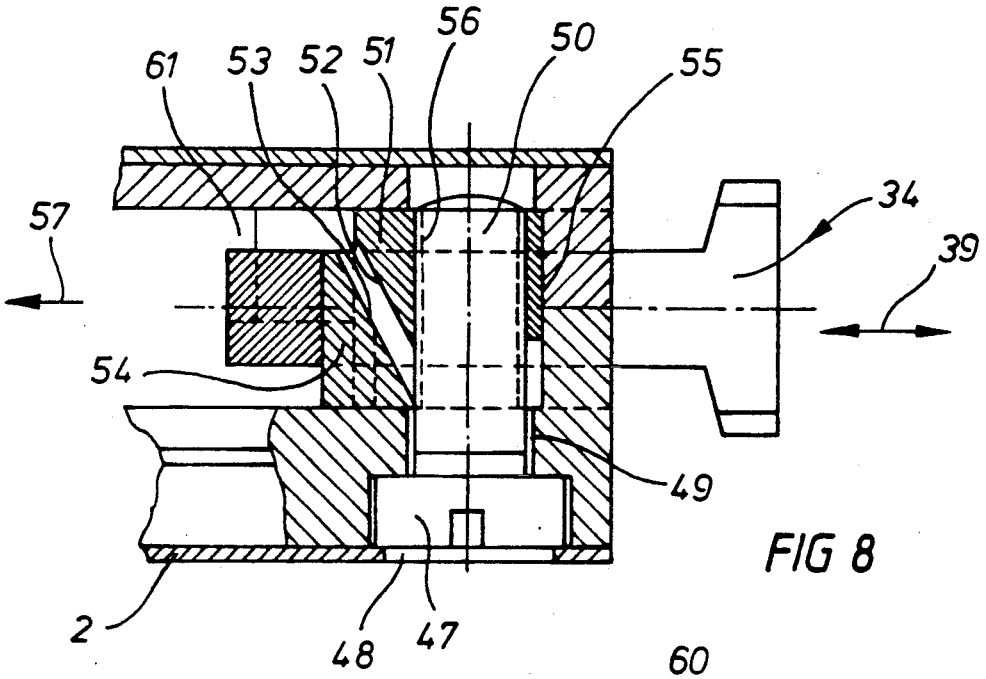

Adjustment in the arrow directions 39 is effected as follows:

In FIG. 8, a locking screw 47 is provided which is accessible through a recess 48 in the side wall of the side part 2,3.

The locking screw is in turn seated in a recess 49 in the side wall of the side part.

Flush with said recess, but substantially enlarged, is a recess provided in the adjustable part 34. Said recess is designated 55.

The adjusting screw 47 therefore engages with its screw bolt 50 into a recess 55 of the adjustable part 34. Provided in the region of said recess is an adjusting wedge having an internal thread 56 into which the screw bolt is screwed. The adjustable part has a lateral wedge surface 52, associated with which is a wedge surface 53 of an identical type and an identical inclination which is disposed on a wedge 54 inserted in the recess 55.

The adjusting screw therefore engages with its bolt 50 in to the recess 55 of the adjustable part; and so do the wedge 51 and the wedge 54.

Said parts are shown in their detached state in FIG. 8.

As soon as the adjusting screw 47 is turned, the wedge 51 is moved in the direction of the screw longitudinal axis, downwards in FIG. 8, and the wedge surface 52 runs into the wedge surface 53. The two wedge surfaces slide against one another so that the adjustable part 34 is moved inwards in arrow direction 57.

As a result of this adjustment, a force- and form-locking fit of the front panel 1 against the side parts 2,3 and their front region is achieved.

Provided on the rearward inner side of the front panel are drive-in pegs 58 in which corresponding location holes 59 are disposed. The projections 36, which are enlarged in a plate-like manner and are chamfered in a wedge shape, engage into said location holes 59. This type of connection is prior art.

It is important for the adjustment arrangement in arrow directions 38 to allow a relatively large process tolerance for the drawer.

The distance between the opposing, spaced-apart side parts 2,3 is not always constant.

In order to compensate these production-related variations in distance, it is provided that the adjustable part 34 is disposed in a substantially larger recess 60 in the side wall of the side part 2. This is also the reason why the adjusting screw 41 has to be pressed with the aid of the spring 44 against the adjustable part 34 in order permanently to maintain said force-locking contact with the adjustable part 34.

The adjustable part 34 is therefore displaceable and movable in the region of said recess 60 in order that wide variations in the distance between the opposing side parts 2,3 may be bridged and yet the front panel may be connected securely to the side parts by means of the connector 58.

It is also important for the recess 61 of FIG. 8 to allow a large adjustment play at right angles to the drawing plane of FIG. 7.

Figure 10:
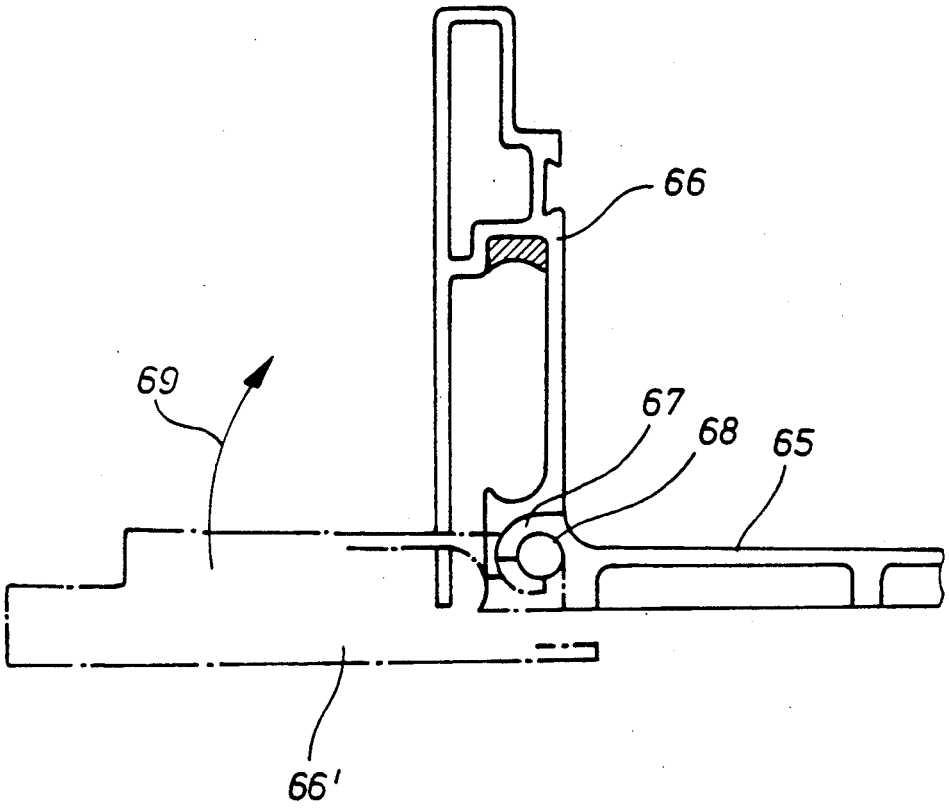

FIG. 10 shows a further connection type, as it is used for extruded hollow profiles. There, it is important for the drawer bottom 65 to be connected, again pivotably, but non-detachably to a side part 66. In this embodiment, the drawer bottom has a rounded-off projection 67 which defines a semi-circular recess 68. The side part is shown by the dash-dot lines in the swivelled-down position 66' and, if it is swivelled in arrow direction 69, it assumes the position shown by solid lines.

In terms of shaping, the side parts 66 and the drawer bottom 65 consequently take the form of hollow boxes, with the drawer bottom 65 having webs on the base for support and forming at the sides with the semi-circular projection 67, which forms a recess 68, a hinge in which a hinge pin of the side part 66 further engages. Said hinge pin 68 of the side part is in accordance with the semi-circular projection 67 of the bottom supported on a projection which merges into a semi-circular recess and subsequently the side parts extend linearly thereon. The side parts 66, in a similar manner to the drawer bottom 65, are constructed like hollow boxes, with support profiles which form closed hollow areas being disposed in the side parts, while one end of the side part closes off the side part 66 to the outside in the manner of a drawn-off side wall. Upon swivelling of the side part 66 in arrow direction 69, the moulded-on hinge parts engage in one another in a mutually overlapping semi-circular movement, thereby creating a dust-tight and virtually airtight connection in the hinge region. The hinge regions of the extruded hollow profiles may be constructed continuously along the side parts and the drawer bottom or alternatively only projection-like curved hinge parts may be moulded on.

What is claimed is:

1. A drawer slideably mountable in a frame and having opposing side walls, a back wall, a front panel and a drawer bottom provided with a downwardly directed drawer bottom projection along at least three sides of the drawer bottom, the inprovement wherein the side walls and the back wall are continuously connected in hinged manner along substantially the entire length of said at least three sides the drawer bottom, said side walls and back wall are provided with an open groove having a groove opening and an inward directed hook-like first groove projection, said drawer bottom projection projecting through said groove opening to hingedly engage said open groove and said first groove projection enabling hinged movement of said side and back walls between upright and folded down positions relative to said drawer bottom and in said upright position bracing the bottom wall projection against the groove; and the drawer front panel is detachably connected to said side walls.

2. The drawer of claim 1, wherein said open groove of said side walls and back wall is provided with a second groove projection of increased length relative to said first groove projection which rest on said drawer bottom and braces said side and back walls when said side/walls and said back/walll are in said upright position.

* * * * *